US007487736B2

(12) United States Patent
Daley

(10) Patent No.: US 7,487,736 B2
(45) Date of Patent: Feb. 10, 2009

(54) HYBRID BOAT HULL

(76) Inventor: Carl Daley, 939 NE. 73rd Ave., Hillsboro, OR (US) 97124

( * ) Notice: Subject to any disclaimer, the term of this patent is extended or adjusted under 35 U.S.C. 154(b) by 0 days.

(21) Appl. No.: 11/619,171

(22) Filed: Jan. 2, 2007

(65) Prior Publication Data

US 2008/0127874 A1 Jun. 5, 2008

Related U.S. Application Data

(60) Provisional application No. 60/868,722, filed on Dec. 5, 2006.

(51) Int. Cl.
*B63B 1/00* (2006.01)

(52) U.S. Cl. ..... 114/271; 114/61.1

(58) Field of Classification Search ..... 114/61.1, 114/61.2, 61.21, 283, 274, 62, 61.32, 140, 114/271, 288, 289
See application file for complete search history.

(56) References Cited

U.S. PATENT DOCUMENTS

| | | | | | |
|---|---|---|---|---|---|
| 2,503,480 | A | * | 4/1950 | Gruszecki | 440/9 |
| 2,666,406 | A | * | 1/1954 | Babcock | 114/288 |
| 3,307,511 | A | * | 3/1967 | Chapman | 114/61.21 |
| 3,381,920 | A | * | 5/1968 | Beringer | 244/105 |
| 3,968,762 | A | | 7/1976 | Meyer, Jr. | |
| 4,228,752 | A | * | 10/1980 | Sladek et al. | 114/67 A |
| 4,606,291 | A | * | 8/1986 | Hoppe | 114/274 |
| 4,615,291 | A | | 10/1986 | Jones | |
| 4,665,853 | A | * | 5/1987 | Gerdsen et al. | 114/274 |
| 4,813,366 | A | | 3/1989 | Elder | |
| 4,926,773 | A | | 5/1990 | Manor | |
| RE33,359 | E | * | 10/1990 | Lang | 114/283 |
| 4,996,935 | A | | 3/1991 | Takeuchi | |
| 5,191,848 | A | | 3/1993 | Hatfield | |
| 5,448,963 | A | | 9/1995 | Gallington | |
| 5,503,100 | A | | 4/1996 | Shaw | |
| 5,522,333 | A | | 6/1996 | Lang et al. | |
| 5,526,762 | A | * | 6/1996 | Kiley | 114/61.2 |
| 5,544,607 | A | | 8/1996 | Rorabaugh et al. | |
| 6,058,872 | A | | 5/2000 | Latorre | |
| 6,065,415 | A | * | 5/2000 | Orr | 114/61.1 |
| 6,311,635 | B1 | * | 11/2001 | Vaton | 114/272 |
| 6,439,148 | B1 | | 8/2002 | Lang | |
| 6,679,192 | B2 | | 1/2004 | DeMarco | |
| 6,748,893 | B1 | | 6/2004 | Jorde et al. | |
| 2004/0206290 | A1 | | 10/2004 | Morris | |
| 2005/0247251 | A1 | | 11/2005 | Scism et al. | |
| 2006/0144312 | A1 | | 7/2006 | Baker | |

FOREIGN PATENT DOCUMENTS

| | | |
|---|---|---|
| JP | 55-148680 | * 11/1980 |
| JP | 7040885 | 2/1995 |
| JP | 11105782 | 4/1999 |
| JP | 2002274480 | 9/2002 |

* cited by examiner

*Primary Examiner*—Ed Swinehart
(74) *Attorney, Agent, or Firm*—Christopher Wood; Wood & Eisenberg, PLLC

(57) ABSTRACT

A hybrid boat hull. In a first embodiment, the hybrid boat hull comprises a first and second outer elongated hulls each curved inwards to respectively define first and second keel fins which provide buoyancy and act as inclined hydrofoils when the hybrid hull is run at high speed. In a second embodiment, the hybrid boat hull further comprises an elongated central hull, which serves to dampen the effect of slamming of waves on the underside of the hybrid boat hull.

5 Claims, 14 Drawing Sheets

HYBRID BOAT HULL

CROSS-REFERENCE TO RELATED APPLICATIONS

This application claims the benefit of priority from U.S. Provisional Patent Application Ser. No. 60/868,722, filed Dec. 5, 2006, the entire contents of which are incorporated herein by reference.

STATEMENT REGARDING FEDERALLY SPONSORED RESEARCH OR DEVELOPMENT

Not Applicable.

FIELD OF THE INVENTION

This invention relates to boat hulls. Specifically, the invention is directed to a hybrid boat hull.

BACKGROUND OF THE INVENTION

There is a need for useful water vessel hull designs. Hull designs that offer more efficient hydrodynamic designs are in particular demand. Of particular need are hull designs that offer fuel cost savings and/or greater stability on water. Various designs have grown out of such need such as modified versions of the traditional single hull design, multi-hull designs such as the double hull catamaran and triple hulled trimaran. The need for faster water vessels has seen the development and deployment of hydrofoils that help lift vessel hulls out of the water thereby decreasing contact between the boat hull and the water on which the boat is traveling.

A review of prior art follows.

U.S. Pat. No. 5,503,100, issued Apr. 2, 1996 to Shaw, describes a hybrid high performance water vessel having an upper hull with a pair of main fluid-lifting-plane means also referred by Shaw as mainfoils, for providing hydrodynamic lifting force at high speed; and a torpedo shaped streamlined sub-hull disposed beneath the water line, for providing the majority of flotation. Along the water line is a knife-like slender hull called mainstrut that pierces through water surface to minimize the crucial wave-making resistance. The mainfoils are located close to one end section of the vessel, and the sub-hull is placed at the other end section of the vessel, so that the center of hydrodynamic lifting force of the mainfoils and the center of buoyancy of the water vessel is offset substantially along the longitudinal axis of the vessel system. It enables the water vessel of present invention to have a "Hull Inclination" capability that improves the performances of the water vessels.

At high speed, the Shaw vessel is said to incline in a longitudinal direction such that the sub-hull submerges into the water and the upper hull is lifted and held above the water surface. The mainfoils are described as providing rolling and substantial pitching control at high speed. When operating in a shallow or an unfamiliar water way with low speed, the vessel inclines longitudinally in an opposite direction, such that the sub-hull is raised up and close to the water surface for reducing the draught.

U.S. Pat. No. 5,191,848, issued Mar. 9, 1993 to Hatfield, describes a catamaran vessel with a pair of spaced apart, parallel hulls which are made of sealed watertight configuration of composite marine material and interconnected by a deck and cabin structure with depending stilts joined to the hulls. The hulls have a wave piercing configuration in which the length to beam or fineness ratio of each hull is approximately 16.3:1 with a prow that is essentially knife-edged and vertical, the vertical section contours of the forward portion of the hull are elliptical and gradually transition to an essentially rectangular contour along the rear portion. The underside of the deck between the stilts has a convex undersurface which constitutes a planing hull structure above the top of the pair of hulls and between the stilts. The depicted vessel is power driven by motor-driven propellers at the stern of each hull. The specific hull configuration is a wave-piercing hull that can be combined in multi-hull ocean going vessels, such as proas (single main hull), catamarans (two hulls) and trimarans (three hulls).

U.S. Pat. No. 6,058,872, issued May 9, 2000 to Latorre, describes a catamaran-type boat having two or more demi-hulls that are connected by a wing-shaped superstructure. Two or more transverse hydrofoils further connect the demi-hulls. A tunnel is created between the demi-hulls and the superstructure. The shape of the superstructure takes advantage of the airflow through the tunnel to provide aerodynamic lift. The hydrofoils serve two purposes. The first is to provide hydrodynamic lift, and the second is to cancel wave build up between the hulls. The wave cancellation assists the stability of the craft by providing a relatively flat surface for the wing, to provide stable additional lift through the "wing in ground" effect. The combination of hydrodynamic lift, wave cancellation, and aerodynamic lift decreases the ship's drag and increases its speed.

U.S. Patent Publication No. 20060144312, published Jul. 6, 2006 to Baker, describes a watercraft hull design that comprises a hull having a bow, stem, top, and bottom. A wedge-shaped wave spreading system is located at a forward portion of the craft. The wave-contacting surface planes of the wave spreading system are positioned substantially perpendicular to the plane of smooth water. The bottom edge of the wave spreading system is positioned near the level of smooth water when the watercraft is at cruising speed. The wave spreading system has a forward apex, which forms a substantially perpendicular or vertical leading wedge to the plane of water. Since the apex and planes of the wave spreader are substantially perpendicular to the water, oncoming waves encountered by the wave spreader will tend to be deflected horizontally. Accordingly, such watercrafts tend to "cut through" waves instead of riding over them. Located rearwardly of the wave spreader, an internal hull prow is spaced from the wave spreading system, creating an air space therebetween. The air space extends from the rearward surface of the wave spreader to the front of internal hull prow, creating a buffer zone or dampening space to further minimize any wave action not detected by the spreading system.

SUMMARY OF THE INVENTION

A hybrid boat hull. In a first embodiment, the hybrid boat hull comprises first and second outer elongated hulls each curved inwards to respectively define first and second keel fins that provide buoyancy and act as inclined hydrofoils when the hybrid hull is run at high speed. In a second embodiment, the hybrid boat hull further comprises an elongated central hull, which serves to dampen the effect of slamming waves on the underside of the hybrid boat hull.

BRIEF DESCRIPTION OF THE DRAWINGS

Similar reference characters denote corresponding features consistently throughout the attached drawings.

DETAILED DESCRIPTION OF THE INVENTION

This invention relates to boat hulls. Specifically, the invention is directed to a hybrid boat hull. Still more specifically, the hybrid boat hull of the present invention has two principal embodiments, a first embodiment and a second embodiment. In the first embodiment, a hybrid boat hull comprises a first and second outer elongated hulls each curved inwards to respectively define first and second keel fins which provide buoyancy and act as hydrofoils when the hybrid hull is run at high speed. In the second embodiment, the hybrid boat hull further comprises an elongated central hull, which serves to dampen the effect of slamming waves on the underside of the hybrid boat hull.

The first embodiment of the hybrid boat hull of the present invention is denoted generally by the alphanumeric label "100*a*", and the second embodiment of the hybrid boat hull of the present invention is denoted generally by the alphanumeric label "100*b*".

The boat hulls of the present invention can be made out of any suitable material such as, but not limited to, glass reinforced plastic such as, but not limited to, fiberglass reinforced plastic ("FRP") or glass reinforced epoxy ("GRE"). Alternatively, boat hulls of the invention can be made out of any suitable metal such as, but not limited to, aluminum. Exotic alloys can also be used such as titanium alloy.

Figure 1:
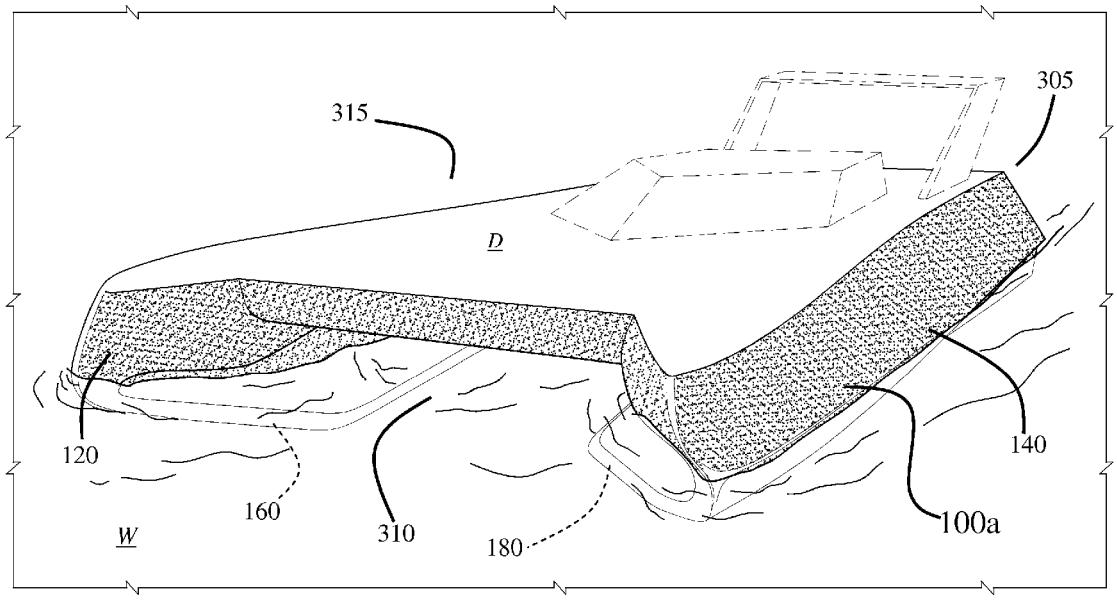
FIG. 1 shows a perspective environmental view of the hybrid boat hull according to the first embodiment of the invention.

FIG. 1 shows a perspective environmental view of hybrid boat hull 100*a*, which is shown traveling at low speed through water W. The hybrid boat hull 100*a* comprises first and second outer elongated hulls 120 and 140, respectively. Decking D is fitted over the hybrid boat hull 100*a*. The term "decking" refers to the horizontal structure that forms the lid of a boat hull.

The first and second outer hulls 120 and 140 each curve inwards with respect to the reference vertical plane of two-fold symmetry VP2FS (shown in FIG. 3) of hybrid boat hull 100*a* thereby defining first and second keel fins 160 and 180, respectively. The first and second keel fins 160 and 180 are integral with and continuous with first and second outer hulls 120 and 140, respectively.

Figure 7:
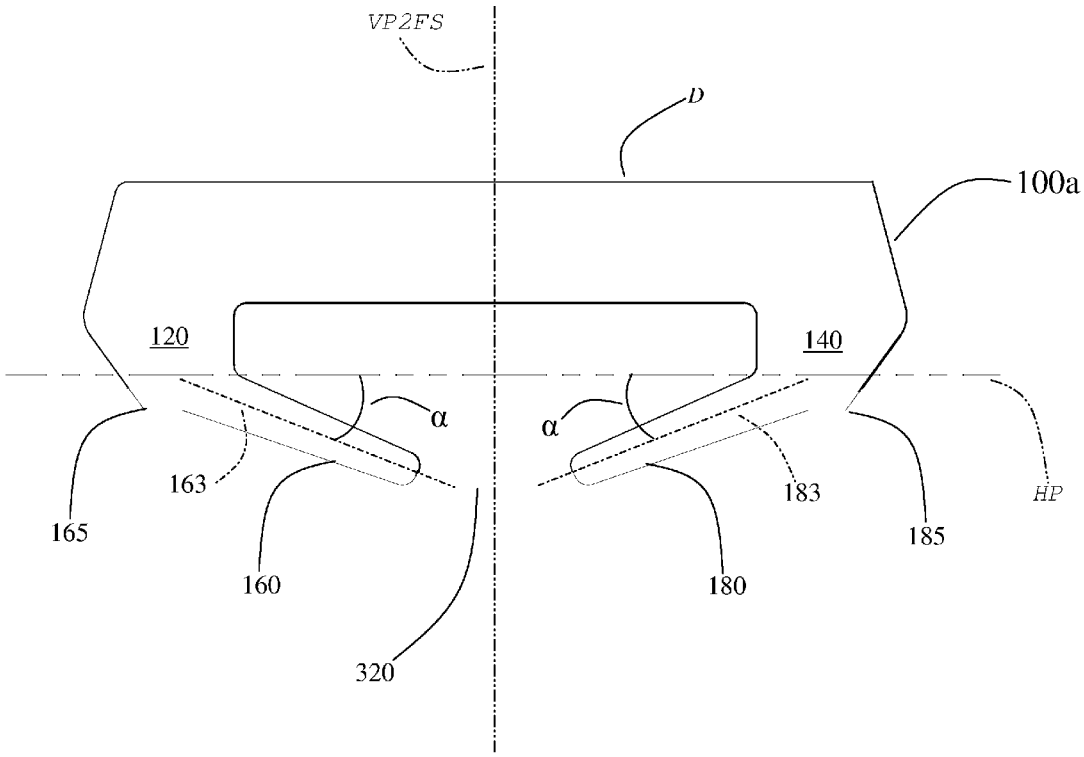
FIG. 7 shows another section view of the hybrid boat hull of FIG. 1.

As can be seen in FIG. 7, the first and second keel fins 160 and 180 are each angled inwards with respect to the reference vertical plane of two-fold symmetry VP2FS. More specifically, the first and second keel fins 160 and 180 respectively define first and second bisecting longitudinal planes 163 and 183. The first and second keel fins 160 and 180 are each angled inwards towards the vertical plane of two-fold symmetry VP2FS at an angle of about 20° to about 25° with respect to the horizontal plane HP and each respective bisecting longitudinal plane 163 and 183.

Figure 2:
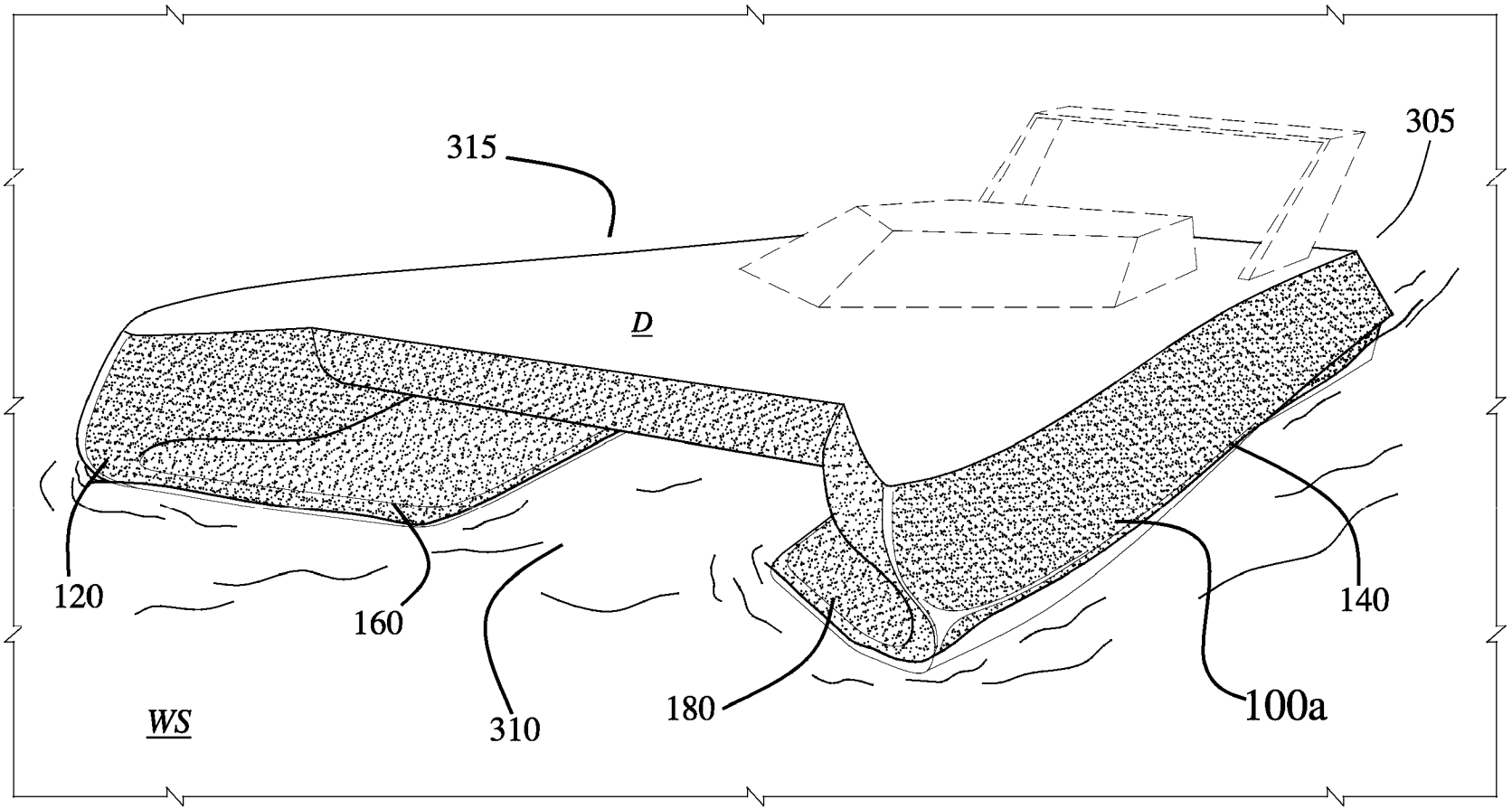
FIG. 2 shows another perspective environmental view of the hybrid boat hull according to the first embodiment of the invention.

FIG. 2 shows a perspective environmental view of hybrid boat hull 100*a*, which is shown traveling at higher speed through water. The first and second keel fins 160 and 180 are visible on the water surface WS indicating that the hull 100*a* is planing on the water surface and, more particularly, that the underside surfaces 200 and 220 (see FIG. 6) of the first and second keel fins 160 and 180 are planing on the water surface WS.

At slow speeds, as depicted in FIG. 1, the first and second outer hulls 120 and 140 behave somewhat like conventional catamaran hulls, but at higher speeds, as depicted in FIG. 2, the first and second outer hulls 120 and 140 behave as hydrofoils. More specifically, the first and second keel fins 160 and 180, which are respectively integral appendages of first and second outer hulls 120 and 140, remain submerged at slow speeds and engage the water surface WS at higher speeds.

Figure 3:
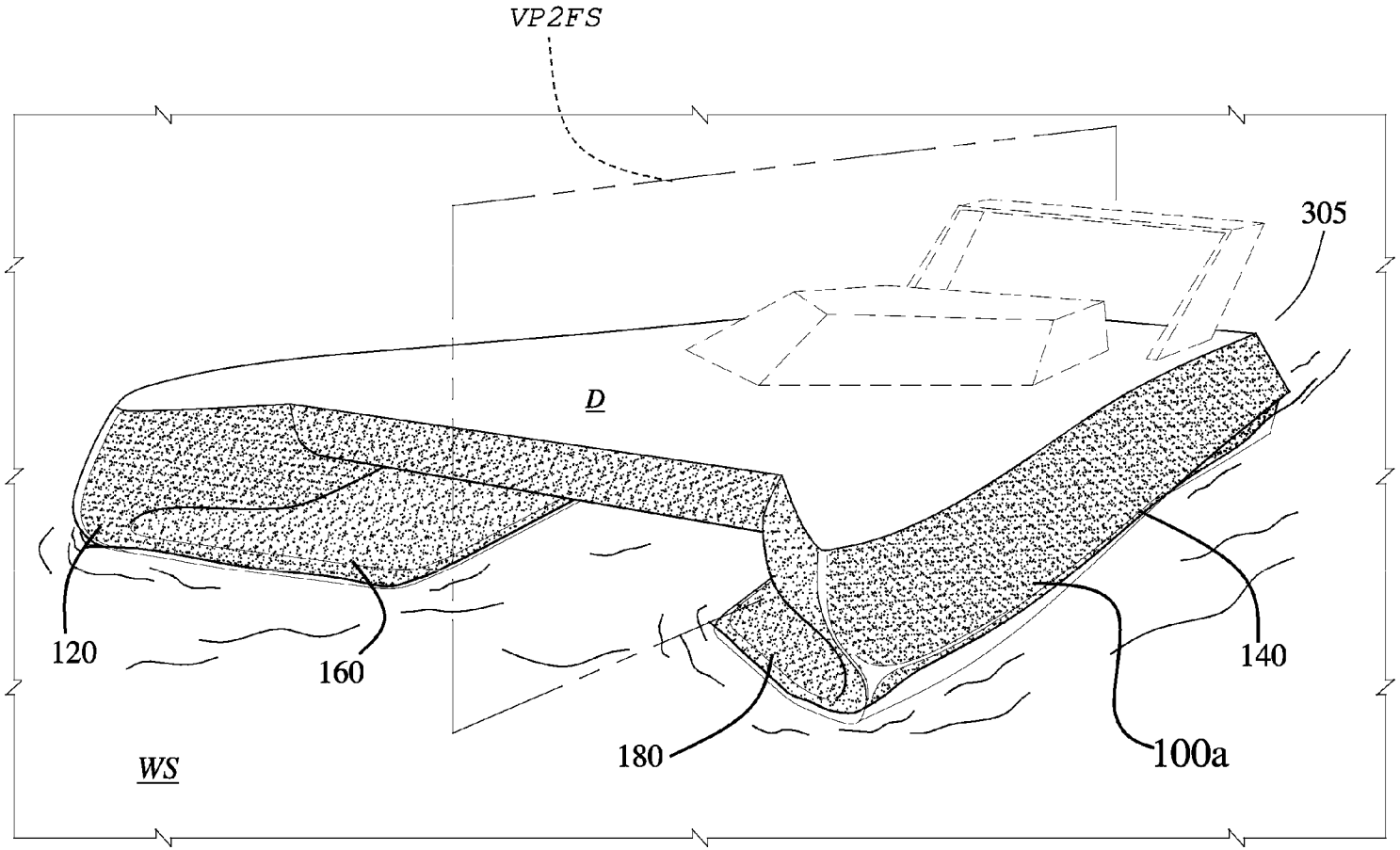
FIG. 3 shows another perspective environmental view of the hybrid boat hull according to the first embodiment of the invention.

Referring to FIG. 3, the first and second keel fins 160 and 180, like their parent first and second outer hulls 120 and 140, are substantially mirror images of each other. The first and second keel fins 160 and 180 respectively define first and second leading edges 240 and 260 (see, e.g., FIG. 4). The first and second leading edges 240 and 260 curve inwards towards the vertical plane of two-fold symmetry VP2FS and substantially straighten to define first and second keel-fin edges 280 and 300, respectively. First and second keel-fin edges 280 and 300 may or may not be parallel with respect to each other. For example, first and second keel-fin edges 280 and 300 may diverge or converge in the direction of the stern 305 or bow 310 of the hybrid hull 100*a*. First and second keel-fin edges 280 and 300 define a keel-fin gap 320, which in turn may have parallel boundaries if the first and second keel-fin edges 280 and 300 are parallel. The keel-fin gap 320 runs from about the midsection 315 to the stern 305 of hull 100*a* (see, for example, FIG. 5). Alternatively, keel-fin gap 320 may converge or diverge between the mid-section 315 and stern 305 in sympathy with first and second keel-fin edges 280 and 300.

Figure 4:
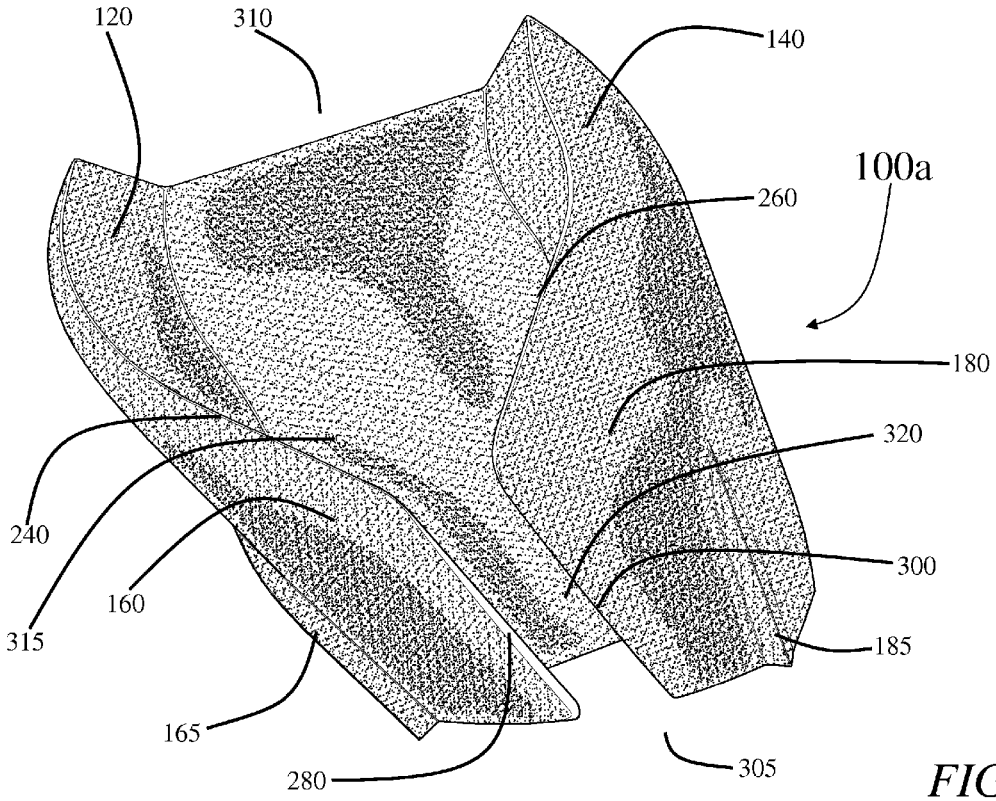
FIG. 4 shows a perspective view of the underside of the hybrid boat hull of FIG. 1.
Figure 5:
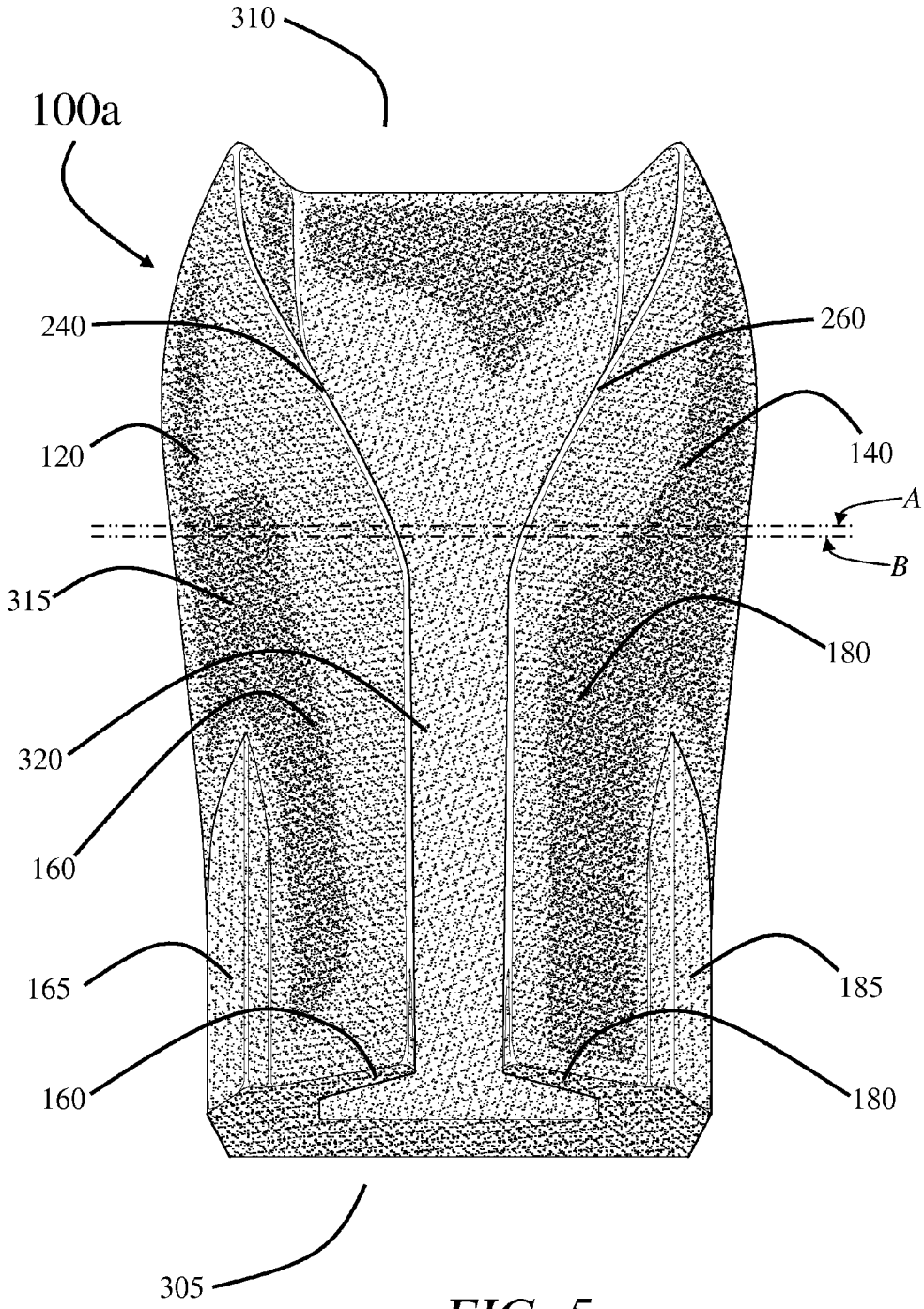
FIG. 5 shows another view of the underside of the hybrid boat hull of FIG. 1.

FIGS. 4 and 5 show the underside of hybrid boat hull 100*a*. Optional first and second strakes 165 and 185 are provided along the outboard side of the keel-fins 160 and 180, respectively. The optional first and second strakes 165 and 185 serve to enhance the planing capability of the hybrid hulls 100*a* and 100*b* and help keep down the wake.

Figure 6:
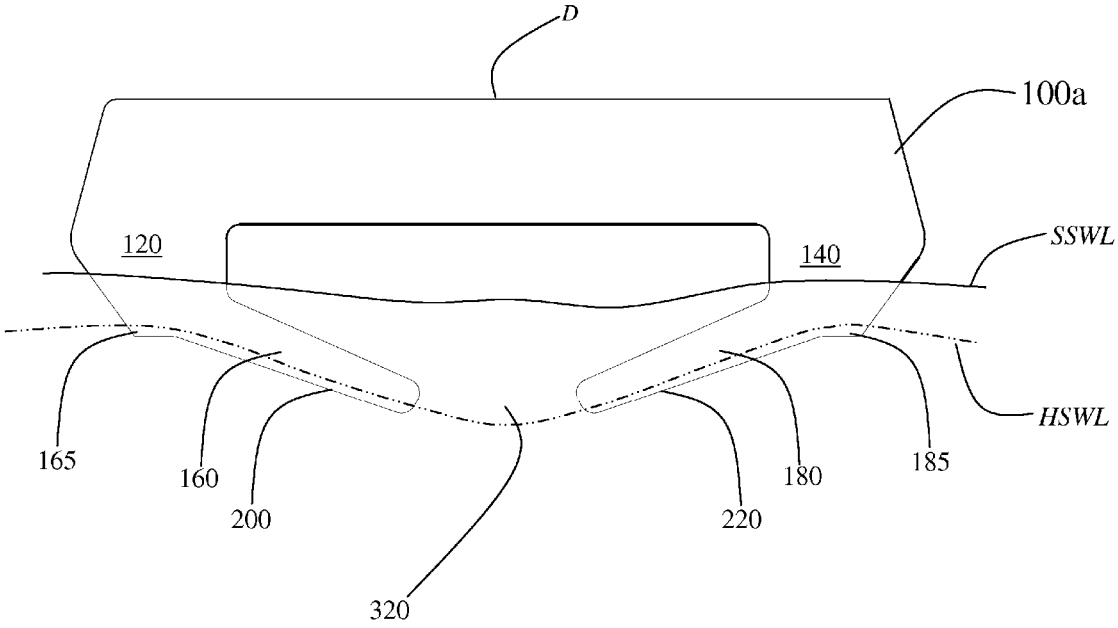
FIG. 6 shows a section view of the hybrid boat hull of FIG. 1.

FIG. 6 shows a section view between lines A and B of FIG. 5. At slow water speed the water level is found at about SSWL, and at high water speed the water level is found at about HSWL.

Referring to FIG. 7, the first and second keel fins 160 and 180 are angled at about 20° to about 25° (represented by symbol "α") with respect to the horizontal plane HP, and angled inwards towards the vertical plane of two-fold symmetry VP2FS (shown in FIG. 3) of hull 100*a*.

Referring generally to FIGS. 8 through 14 that illustrate various views of the second embodiment, i.e., hybrid boat hull 100*b*, the hybrid boat hull 100*b* further comprises an elongated central hull 130 positioned between first and second outer elongated hulls 120 and 140. The elongated central hull 130 serves to dampen the effect of slamming waves on the underside of the hybrid boat hull.

Figure 8:
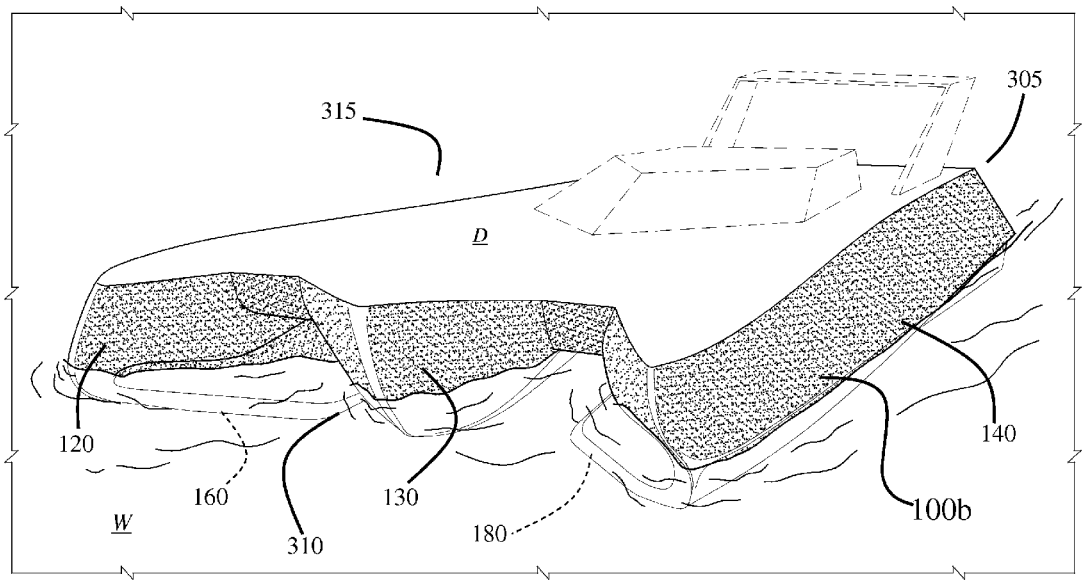
FIG. 8 shows a perspective environmental view of the hybrid boat hull according to the second embodiment of the invention.

FIG. 8 shows a perspective environmental view of hybrid boat hull 100*b*, which is shown traveling at low speed through water W. The hybrid boat hull 100*b* comprises first and second outer elongated hulls 120 and 140, respectively. Decking D is fitted over the hybrid boat hull 100*b*. The term "decking" refers to the horizontal structure that forms the lid of a boat hull.

Figure 9:
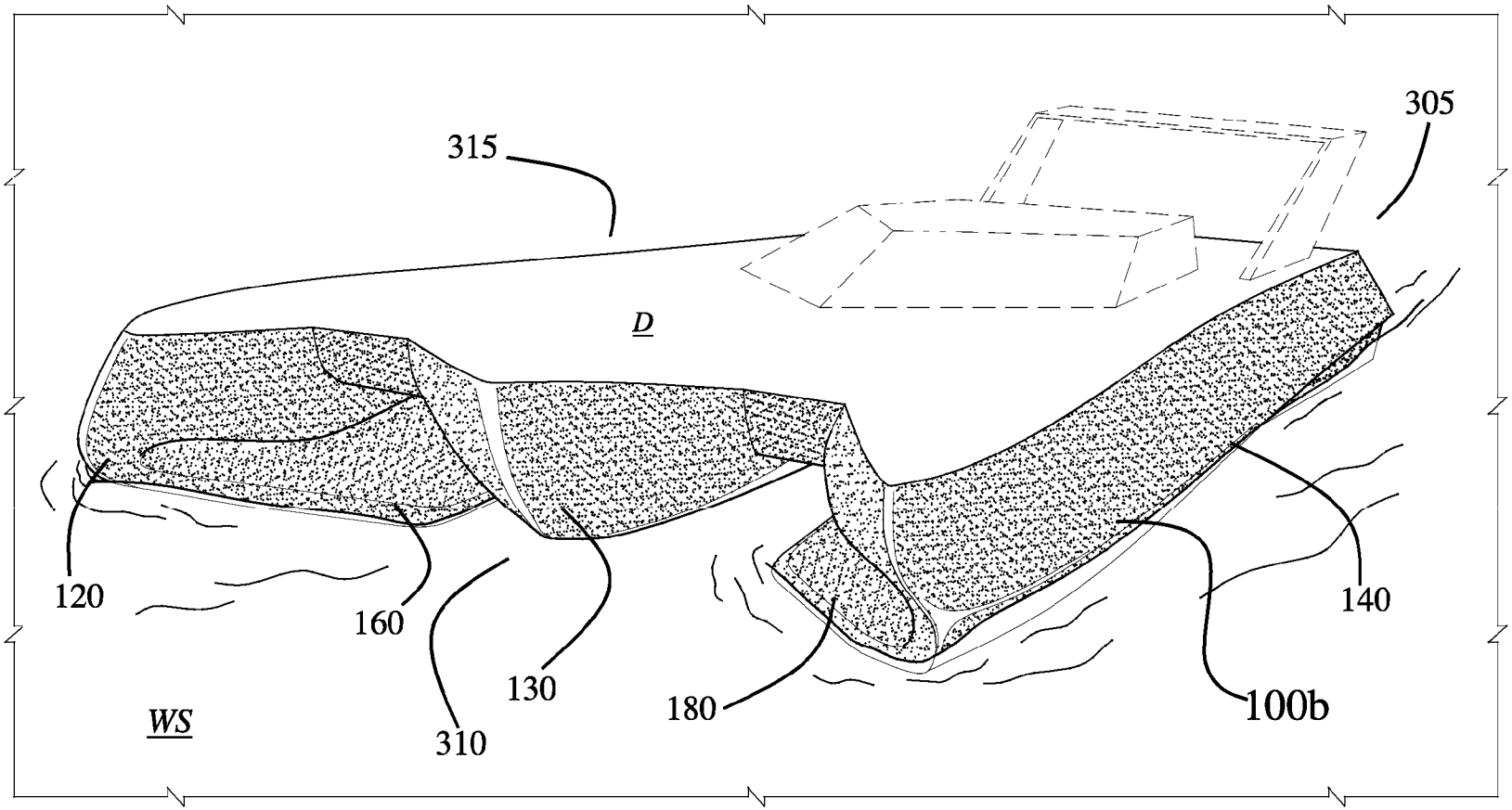
FIG. 9 shows another perspective environmental view of hybrid boat hull according to the second embodiment of the invention.

FIG. 9 shows a perspective environmental view of hybrid boat hull 100*b*, which is shown traveling at higher speed through water. The first and second keel fins 160 and 180 are visible on the water surface WS indicating that the hull 100*b* is planing on the water surface and, more particularly, that the underside surfaces 200 and 220 (see FIG. 13) of the first and second keel fins 160 and 180 are planing on the water surface WS.

At slow speeds, as depicted in FIG. 8, the first and second outer hulls 120 and 140 behave somewhat like conventional catamaran hulls, but at higher speeds, as depicted in FIG. 9, the first and second outer hulls 120 and 140 behave like hydrofoils. More specifically, the first and second keel fins 160 and 180, which are respectively integral appendages of first and second outer hulls 120 and 140, remain submerged at slow speeds and engage the water surface WS at higher speeds as shown in FIG. 9.

Figure 10:
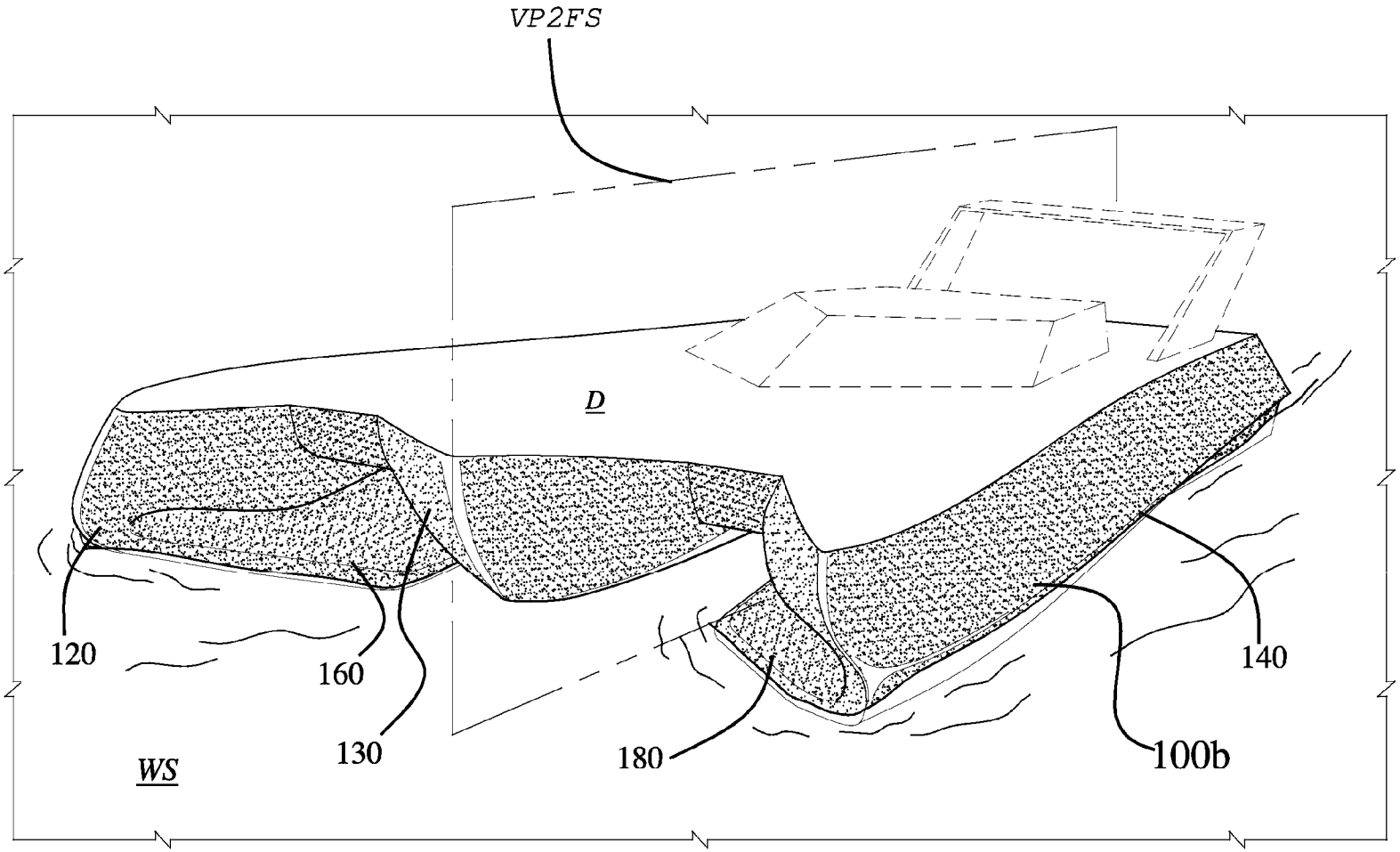
FIG. 10 shows another perspective environmental view of the hybrid boat hull according to the second embodiment of the invention.

Referring to FIG. 10, the first and second keel fins 160 and 180, like their parent first and second outer hulls 120 and 140, are substantially mirror images of each other. The first and second keel fins 160 and 180 respectively define first and second leading edges 240 and 260 (see, e.g., FIG. 12). The first and second leading edges 240 and 260 curve inwards towards the vertical plane of two-fold symmetry VP2FS and substantially straighten to define first and second keel-fin edges 280 and 300, respectively. First and second keel-fin edges 280 and 300 may or may not be parallel with respect to each other. For example, first and second keel-fin edges 280 and 300 may diverge or converge in the direction of the stem 305 or bow 310 of the hybrid hull 100*b*. First and second keel-fin edges 280 and 300 define a keel-fin gap 320, which in turn may have parallel boundaries if the first and second keel-fin edges 280 and 300 are parallel. The keel-fin gap 320 runs from about the midsection 315 to the stern 305 of hull 100*b* (see, for example, FIG. 12). Alternatively, keel-fin gap 320 may converge or diverge between the mid-section 315 and stem 305 in sympathy with first and second keel-fin edges 280 and 300.

Figure 11:
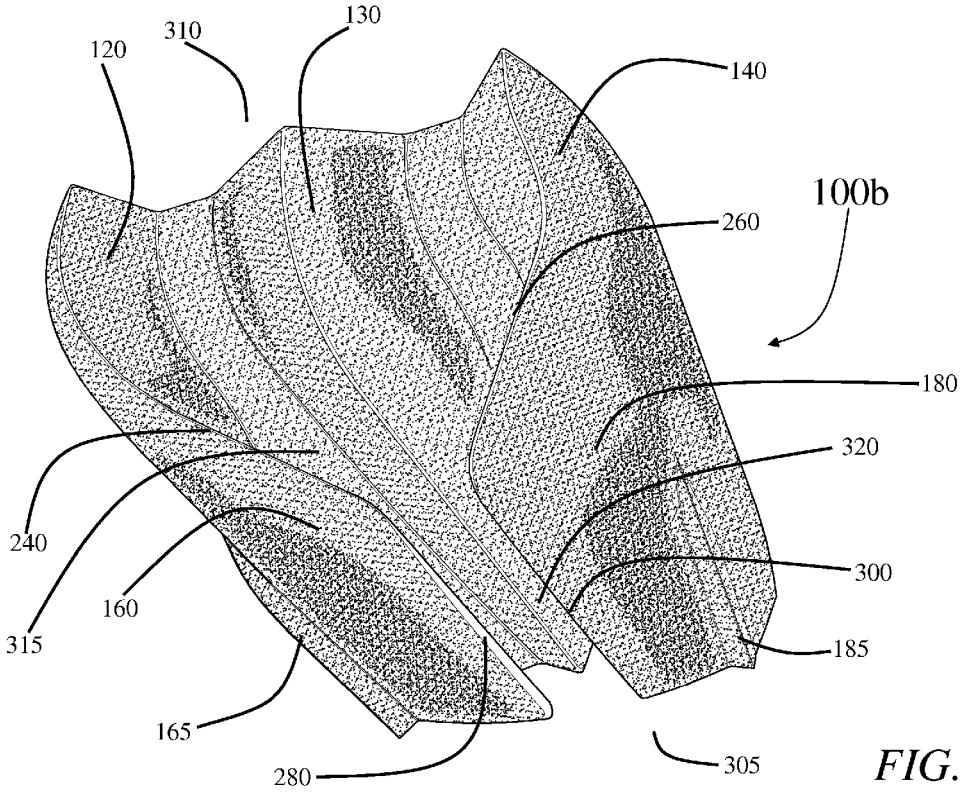
FIG. 11 shows a perspective view of the underside of the hybrid boat hull of FIG. 8.
Figure 12:
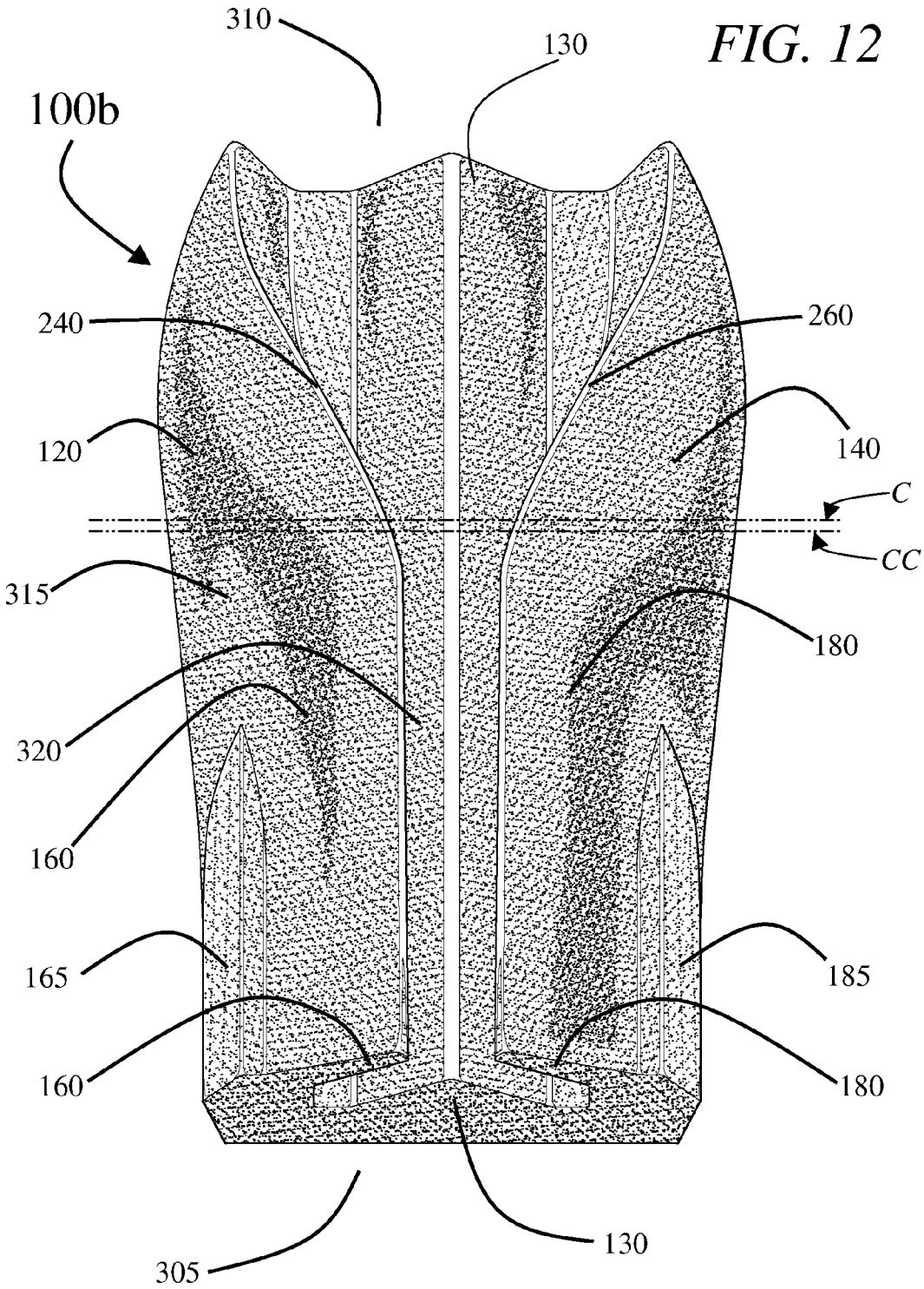
FIG. 12 shows another view of the underside of the hybrid boat hull of FIG. 8.

FIGS. 11 and 12 show the underside of hybrid boat hull 100*b*. Optional first and second strakes 165 and 185 are provided along the outboard side of the keel-fins 160 and 180, respectively. The optional first and second strakes 165 and 185 serve to enhance the planing capability of the hybrid hulls 100*a* and 100*b* and help reduce wake.

Figure 13:
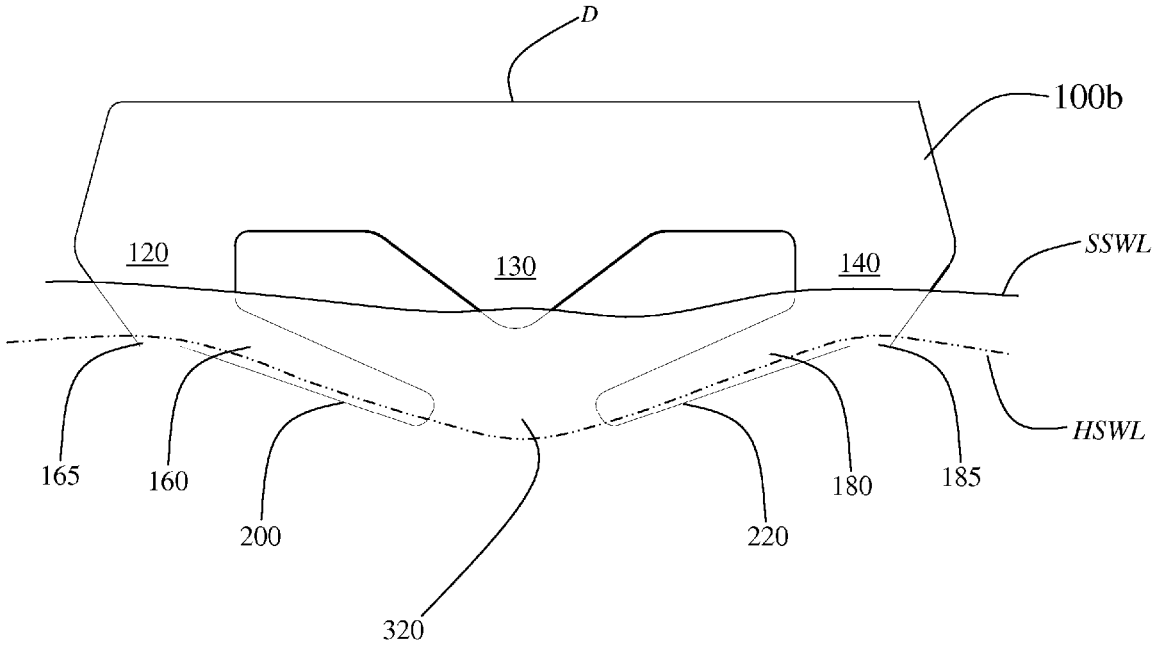
FIG. 13 shows a section view of the hybrid boat hull of FIG. 8.

FIG. 13 shows a section view between lines C and CC of FIG. 12. At slow water speed the water level is found at about SSWL (slow speed water level), and at high water speed the water level is found at about HSWL (high speed water level).

Figure 14:
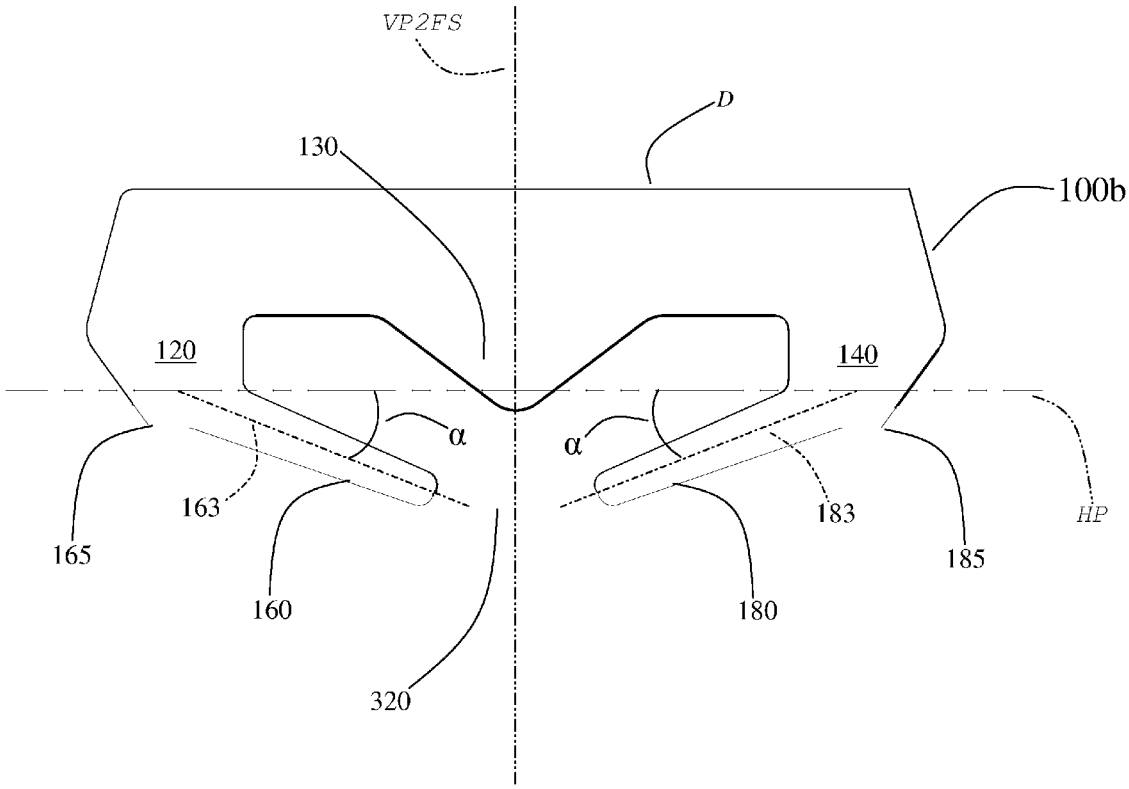
FIG. 14 shows another section view of the hybrid boat hull of FIG. 8.

Referring to FIG. 14, the first and second keel fins 160 and 180 are angled at about 20° to about 25° (represented by symbol "α") with respect to the horizontal plane HP and bisecting longitudinal planes 163 and 183, and angled inwards with respect to the reference vertical plane of two-fold symmetry VP2FS of hull 100*b*.

It is to be understood that the present invention is not limited to the embodiments described above, but encompasses any and all embodiments within the scope of the following claims.

I claim:

1. A hybrid hull with a vertical plane of two-fold symmetry, a bow end, a midsection and a stern end, said hybrid hull comprising:

a first outer elongated hull and a second outer elongated hull;

wherein said first and second outer hulls respectively define first and second keel fins, wherein said first and second keel fins respectively define first and second bisecting longitudinal planes, and wherein said first and second keel fins are each angled inwards such that their respective bisecting longitudinal planes are each angled inwards towards said vertical plane of two-fold symmetry at an angle of about 20° to about 25° with respect to the horizontal plane, wherein said first and second keel fins respectively define first and second leading edges, wherein said first leading edge of said first keel fin curves progressively inwards towards the vertical plane of two-fold symmetry between said bow end and said midsection, said first leading edge of said first keel fin substantially straightens to define first keel-fin edge, wherein the second leading edge of said second keel fin curves progressively inwards towards the vertical plane of two-fold symmetry between said bow end and said midsection, said second leading edge of said second keel fin substantially straightens to define second keel-fin edge, wherein said first and second keel-fin edges define a keel-fin gap and wherein said keel-fin gap extends between said midsection and said stem, wherein said first keel fin has an underside surface capable of planing on a water surface, said underside surface of said first keel fin is located between said midsection and said stern, and wherein said second keel fin has an underside surface capable of planing on a water surface, said underside surface of said second keel fin is located between said midsection and said stern.

2. The hybrid hull according to claim 1, wherein said first and second keel fins respectively define first and second outboard sides, wherein said first and second outboard sides respectively define first and second strakes for reducing vessel wake and enhancing the planing capability of the vessel.

3. A hybrid hull with a vertical plane of two-fold symmetry, a bow end, a midsection and a stern end, said hybrid hull comprising:

a first outer elongated hull, a second outer elongated hull and an elongated central hull;

wherein said first and second outer hulls respectively define first and second keel fins, wherein said first and second keel fins respectively define first and second bisecting longitudinal planes, and wherein said first and second keel fins are each angled inwards such that their respective bisecting longitudinal planes are each angled inwards towards said vertical plane of two-fold symmetry at an angle of about 20° to about 25° with respect to the horizontal plane, wherein said first and second keel fins respectively define first and second leading edges, wherein said first leading edge of said first keel fin curves progressively inwards towards the vertical plane of two-fold symmetry between said bow end and said midsection, said first leading edge of said first keel fin substantially straightens to define first keel-fin edge, wherein the second leading edge of said second keel fin curves progressively inwards towards the vertical plane of two-fold symmetry between said bow end and said midsection, said second leading edge of said second keel fin substantially straightens to define second keel-fin edge, wherein said first and second keel-fin edges define a keel-fin gap and wherein said keel-fin gap extends between said midsection and said stem, wherein said first keel fin has an underside surface capable of planing on a water surface, said underside surface of said first keel fin is located between said midsection and said stern, and wherein said second keel fin has an underside surface capable of planing on a water surface, said underside surface of said second keel fin is located between said midsection and said stern.

4. The hybrid hull according to claim 3, wherein said first and second outer hulls each have greater buoyancy than said elongated central hull.

5. The hybrid hull according to claim 3, wherein said first and second keel fins respectively define first and second strakes for reducing vessel wake and enhancing the planing capability of the vessel.

* * * * *